United States Patent [19]

Reninger

[11] 4,380,200

[45] Apr. 19, 1983

[54] CANDLELAMP-TABLE

[76] Inventor: James D. Reninger, 115 Fiesole St., Venice, Fla. 33595

[21] Appl. No.: 193,203

[22] Filed: Oct. 2, 1980

[51] Int. Cl.[3] ..... A47B 35/00

[52] U.S. Cl. ..... 108/23; 108/50; 362/97

[58] Field of Search ..... 108/23, 50; 431/289, 431/126, 292, 125, 311, 320; 362/161, 447, 121, 97, 410, 392, 810, 415, 162, 163; D26/9

[56] References Cited

U.S. PATENT DOCUMENTS

| | | | |
|---|---|---|---|
| 176,579 | 4/1876 | Barnes et al. | 431/320 |
| 252,906 | 1/1882 | Solt | 108/23 |
| 689,747 | 12/1901 | Pursall | 362/163 X |
| 1,255,614 | 2/1918 | Knapp | 362/163 X |
| 1,653,256 | 12/1927 | Davis | 362/415 |
| 2,530,288 | 11/1950 | Ciano | 431/292 X |
| 2,566,672 | 9/1951 | Nave et al. | 362/410 |
| 2,717,306 | 9/1955 | Meara | 362/163 |
| 3,185,829 | 5/1965 | Rau | 362/97 X |
| 3,315,497 | 4/1967 | MacDonald | 431/292 X |
| 3,355,913 | 12/1967 | Frangos | 431/125 X |
| 3,958,917 | 5/1976 | Naz | 431/289 |
| 4,185,953 | 1/1980 | Schirneker | 431/289 X |
| 4,237,097 | 12/1980 | McDuffie | 431/289 X |

*Primary Examiner*—James T. McCall

*Attorney, Agent, or Firm*—Hauke and Patalidis

[57] ABSTRACT

A candlelamp-table includes a table portion having means supporting a horizontal top to which is secured a liquid fuel reservoir. The top carries a removable candlelamp comprising a base; a pair of inner and outer vertical concentrically arranged and axially spaced apart tubular members; an adapter mounted atop both inner and outer tubular members which extend downwardly into said reservoir; a wick disposed in said inner tubular member and said adapter in such a way that a plurality of fuel vaporizing channels are formed therein, said wick extending downward into said reservoir; and a chimney supported on the base and surrounding said tubular members and adapter.

9 Claims, 7 Drawing Figures

FIG. 1
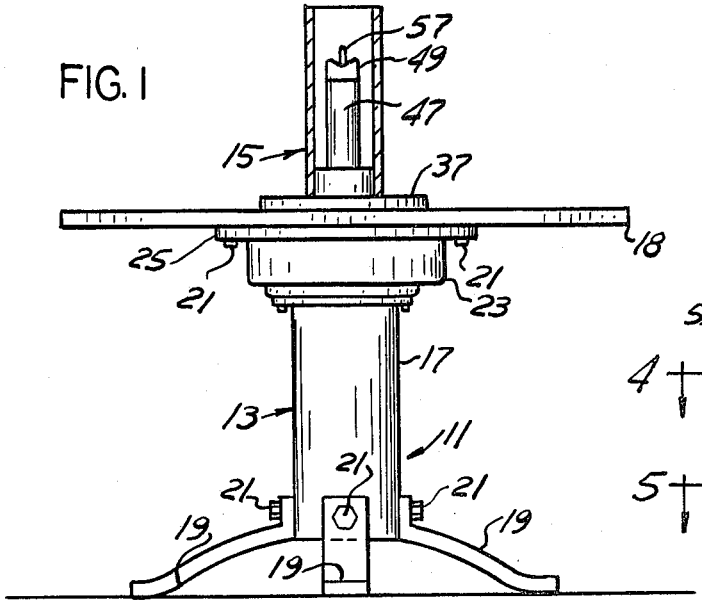
FIG. 3
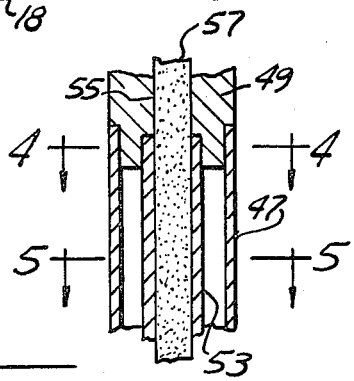
FIG. 4
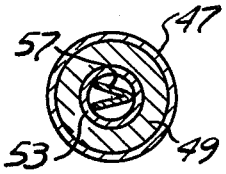
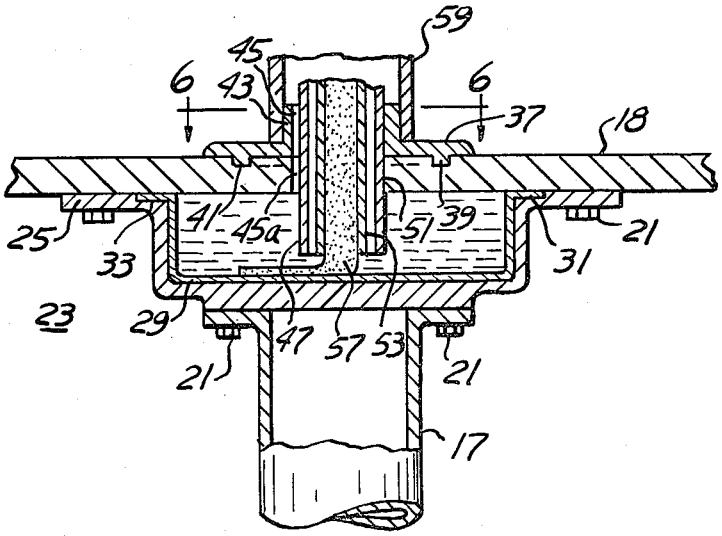
FIG. 2
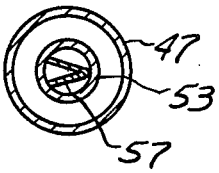
FIG. 5
FIG. 6
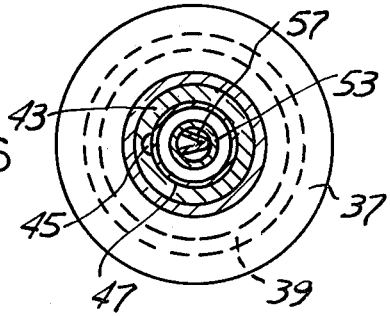
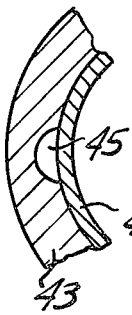
FIG. 7

CANDLELAMP-TABLE

BACKGROUND OF THE INVENTION

The present invention relates to tables generally, and more particularly, to the type of tables used in restaurants, cafes, lunch rooms, lounges and the like, on which there is usually some sort of burning light. The invention is directed to such a table in combination with a candlelamp, as shown and described more particularly hereinafter.

For many years restaurants and other eating establishments have used various forms of candles on tables to decorate the table and to provide illumination while patrons ate in such establishments. More recently, receptacles holding wax, which when hot and liquid supports a wick that burns to provide light on the table. Such light sources must be repalced frequently as the wax candle burns down and as the liquid wax is consumed. In contrast to these kinds of table lights, the candlelamp-table of the present invention is capable of burning for many hours, even for many weeks, without attention.

SUMMARY OF THE INVENTION

A candlelamp-table in accordance with the invention comprises a table having a liquid fuel reservoir in the top; a candlelamp removably placed thereon and having a wick that is immersed in liquid combustible fuel in the reservoir; the candlelamp includes two concentrically arranged and radially spaced apart tubular members, the outer member being supported on the table by a collar that is suitable mounted thereon and that carries at its top an adapter. The inner tubular mamber is carried by the adapter and is dependent therefrom. The wick extends through the inner tubular member upwardly through the adapter and downwardly into the reservoir. An ornamental chimney surrounds the candlelamp.

For a further understanding of the invention and for features and advantages thereof, reference may be made to the following description and drawing illustrating one embodiment of the invention.

BRIEF DESCRIPTION OF THE DRAWING

In the drawing:

FIG. 1 is an elevational view of a candlelamp-table in accordance with one embodiment of the invention;

FIG. 2 is a cross sectional view of a portion of the candlelamp-table of FIG. 1;

FIG. 3 is a sectional view of the top portion of the candlelamp portion shown in FIG. 1;

FIG. 4 is a view along line IV—IV of FIG. 3;

FIG. 5 is a view along line V—V of FIG. 3;

FIG. 6 is a view along line VI—VI of FIG. 2; and

FIG. 7 is an enlarged view of a portion of FIG. 6.

DETAILED DESCRIPTION

Referring to FIG. 1, a candlelamp-table 11 in accordance with the embodiment of the invention shown, comprises a table 13 and a candlelamp 15. The table 13 includes a columnar tubular member 17 to which are mounted a number of legs or feet 19 secured by cap screws 21 or by any other suitable means. A basin-like liquid fuel reservoir 23 is suitably mounted, as by cap screws 21, to the top of the columnar tubular member 17, and a top 18, that may be of wood, metal or plastic covers the basin-like fuel reservoir and is secured thereto by cap screws 21 or in any other suitable manner.

The basin-like liquid fuel reservoir 23 has an appropriate flange 25 through which the cap screws 21 may be inserted to hold the top to the reservoir.

The basin-like reservoir 23 is provided with a synthetic liner adapted and capable of holding liquid fuel, the liner being designated by reference numeral 29. The liner 29 has a flange 31 that is accepted in an annular recess 33 in the flange portion 25 of the basin-like liquid fuel reservoir 23.

The candlelamp portion 15 including a base portion 37 with an annular protrusion 39 that is received by a corresponding annular groove 41 in the table top 18 is positioned in the center of the table top 18. The base portion 37 has an upstanding tubular portion 43 with a vertical semi-circular groove 45 in it. A similar matching semi-circular groove **45*a* is provided in the table top 18, and the two grooves 45, 45*a*, when aligned vertically provide an air passage to allow ambient air to flow into the basin-like liquid fuel reservoir 23**.

A first tubular member 47 is snugly fitted into the tubular portion 43 and extends upwardly from the base portion 37. An adapter 49 having the outward appearance of a conventional wax candle that has been burned for some time is snugly fitted into the top portion of the tubular member 47. The member 47 extends downwardly through a suitable sized opening 51 in the table top 18 and into the basin-like liquid fuel reservoir 23, about as shown in FIG. 2.

The adapter 49 is recessed, as at 53, to receive the upper end portion of a second tubular member 55 that is arranged axially and concentrically with respect to the first tubular member 47. The second tubular member 53 extends downwardly within the first tubular member 47 and terminates at about the same level within the basin-like liquid fuel reservoir 23, about as shown in FIG. 2. The adapter 49 has a vertical bore through it and therein is disposed a flat wick 57, folded about as shown. The wick 57 extends downwardly within the second tubular member 53 and rests on the bottom of the liner 29. The wick 57 also extends slightly above the top of the adapter 49.

Surrounding the tubular members 47, 53 and the adapter 49 is a translucent chimney 59 that may have any desireable shape and color to suit the environment in which the candlelamp-table 11 is used.

In service, a quantity of liquid combustible fuel is disposed in the basin-like fuel reservoir; the candlelamp is set in position on the table top; and the wick is lighted. Thereafter, the chimney is placed around the tubular members and the adapter. The candlelamp will then burn and illuminate the surrounding environment in a decorative and pleasing manner for many hours and days depending on the amount of fuel in the reservoir.

From the foregoing description of one embodiment of the invention, those skilled in the art will recognize many features and advantages of it, among which the following are particularly significant:

That the candlelampportion is much more stable on the table top than conventional small receptacles filled with hot liquid wax and even candles;

That the adapter, which is highly decorative and shaped like a partially burned wax candle, may be colored to suit the decor of the environment; and That the candlelamp is long-burning by virtue of the relatively large supply of fuel in the reservoir.

Although the invention has been described herein with a certain degree of particularity, it is understood that the present invention has been described by way of example as shown in the drawing and that the scope of the invention is defined by what is hereinafter calimed.

What is claimed is:

1. A candlelamp-table comprising:
(a) a horizontal top;
(b) means for supporting said top above a supporting surface;
(c) a reservoir carried by and beneath said top and adapted for holding liquid combustible fuel, said reservoir including an outer shell and a liner adapted for holding said fuel; and
(d) a candlelamp removably supported on said top and having a wick extending upwardly and downwardly into said reservoir.

2. A candlelamp-table comprising:
(a) a horizontal top;
(b) means for supporting said top above a supporting surface;
(c) a reservoir carried by and beneath said top and adapted for holding liquid combustible fuel; and
(d) a candlelamp removably supported on said top and having a wick extending upwardly and downwardly into said reservoir, said candlelamp including,
(i) a base carrying a pair of concentric and spaced apart tubular members, the inner one of which surrounds said wick, and
(ii) an adapter through which said wick extends supported by both tubular members and shaped like a partially burned candle.

3. The invention of claim 2 including:
(a) a translucent chimney surrounding both tubular members and said adapter.

4. The invention of claim 1 including:
(a) means for removably mounting said candlelamp on said top.

5. The invention of claim 2 wherein:
(a) said wick is so constructed and arranged that fuel vaporizing passages are provided in said inner tubular member and in said adapter.

6. The invention of claim 2 including:
(a) an air passage through said base and the top of said table communicating the ambient with said reservoir.

7. A candlelamp-table comprising:
(a) a table portion including a top;
(b) means for supporting said top above a supporting surface;
(c) a reservoir carried by beneath said top and comprising an outer shell and a liner adapted for holding liquid combustible fuel;
(d) a candlelamp portion including
(i) a base removably mounted on said top,
(ii) a pair of spaced-apart inner and outer, concentrically arranged tubular members mounted to said base;
(e) an adapter mounted to the top portion of each of said tubular members;
(f) a wick disposed within said inner tubular member that extends upwardly through said adapter and downwardly into said reservoir; and
(g) a chimney carried by said base that surrounds said tubular members.

8. The invention of claim 7 including:
(a) a passage through said base and said top that carries air into said reservoir.

9. The invention of claim 7 wherein:
(a) said wick is folded so as to provide a plurality of fuel vaporizing passages through said inner tubular member and said adapter.

* * * * *

UNITED STATES PATENT AND TRADEMARK OFFICE

CERTIFICATE OF CORRECTION

PATENT NO. : 4,380,200

DATED : April 19, 1983

INVENTOR(S) : James D. Reninger

It is certified that error appears in the above-identified patent and that said Letters Patent are hereby corrected as shown below:

Col. 4, line 15, after "by" insert --and--.

Signed and Sealed this

*Twenty-first* Day of *June 1983*

[SEAL]

*Attest:*

DONALD J. QUIGG

*Attesting Officer*

*Acting Commissioner of Patents and Trademarks*